US008113160B2

(12) United States Patent
Methley

(10) Patent No.: US 8,113,160 B2
(45) Date of Patent: Feb. 14, 2012

(54) CAMSHAFT PHASING SYSTEM

(75) Inventor: Ian Methley, Witney (GB)

(73) Assignee: Mechadyne, PLC, Kirtlington (GB)

( * ) Notice: Subject to any disclaimer, the term of this patent is extended or adjusted under 35 U.S.C. 154(b) by 126 days.

(21) Appl. No.: 12/708,843

(22) Filed: Feb. 19, 2010

(65) Prior Publication Data

US 2010/0212616 A1 Aug. 26, 2010

(30) Foreign Application Priority Data

Feb. 23, 2009 (GB) ..... 0902906.7

(51) Int. Cl.
*F01L 1/34* (2006.01)

(52) U.S. Cl. ..... 123/90.17; 123/90.33

(58) Field of Classification Search ..... 123/90.12, 123/90.17, 90.31, 90.33
See application file for complete search history.

(56) References Cited

U.S. PATENT DOCUMENTS

| | | | | |
|---|---|---|---|---|
| 6,202,610 | B1 | 3/2001 | Yoshiki | |
| 6,418,897 | B1 * | 7/2002 | Urban et al. | 123/90.17 |
| 6,450,139 | B1 * | 9/2002 | Watanabe | 123/90.17 |
| 6,505,588 | B2 * | 1/2003 | Dietz | 123/90.17 |
| 6,622,675 | B1 * | 9/2003 | Simpson | 123/90.15 |
| 6,725,817 | B2 * | 4/2004 | Methley et al. | 123/90.17 |
| 6,776,131 | B2 * | 8/2004 | Dietz | 123/90.17 |
| 7,426,912 | B2 * | 9/2008 | Lee | 123/90.12 |
| 7,469,670 | B2 * | 12/2008 | Rommel et al. | 123/90.17 |
| 7,503,293 | B2 | 3/2009 | Lettmann et al. | |
| 7,513,232 | B2 | 4/2009 | Schneider | |
| 2007/0295296 | A1 * | 12/2007 | Lettmann et al. | 123/90.17 |
| 2010/0212617 | A1 * | 8/2010 | Murata | 123/90.17 |

FOREIGN PATENT DOCUMENTS

| | | | |
|---|---|---|---|
| JP | 2000220417 | A | 8/2000 |
| JP | 2003166441 | A | 6/2003 |
| JP | 200319813 | A | 9/2003 |

* cited by examiner

*Primary Examiner* — Thomas Denion
*Assistant Examiner* — Daniel Bernstein
(74) *Attorney, Agent, or Firm* — Shalom Wertsberger; Saltamar Innovations

(57) ABSTRACT

An engine cylinder head 10 is disclosed having a first camshaft 14 driven by the engine crankshaft via a phasing system 12 mounted to the camshaft 14. A second camshaft 22 is driven via the phasing system 12 mounted to the first camshaft, and two oil control valves 46, 48 are connected to the phasing system for enabling the phasing system to vary the timing of each camshaft independently with respect to the engine crankshaft in response to oil pressure signals from a respective one of the control valves. In the invention, oil feeds from each control valve 46, 48 enter the camshaft 14 via an oil feed journal 34, 36, and connect to the phaser 12 via axially extending channels within the camshaft 14.

10 Claims, 2 Drawing Sheets

CAMSHAFT PHASING SYSTEM

FIELD OF THE INVENTION

The present invention relates to a double overhead camshaft (DOHC) engine cylinder head with a phasing system for independently varying the phase of each of the camshafts relative to the engine crankshaft.

BACKGROUND OF THE INVENTION

The majority of modern engine designs utilise a double over-head camshaft (DOHC) configuration in which separate camshafts are used to activate the intake valves and the exhaust valves of the engine. Furthermore, it is well known that significant improvements in power output, fuel efficiency and emissions can be achieved by changing the timing of the valve events relative to the engine crankshaft, particularly if the timing of the intake and the exhaust valve events can each be varied independently of the other.

Control of the intake and exhaust valve timing is conventionally achieved by using a camshaft phasing system to drive each camshaft such that each camshaft may be rotated through a defined range of angles with respect to the drive from the crankshaft in response to control signals from the electronic engine control unit (ECU). Various different phasing systems are known from the prior art, but the majority of modern engines utilise vane-type phasers for this purpose.

EP 1 234 954 (U.S. Pat. No. 6,725,817), which is incorporated herein by reference, describes a double vane phaser that is able to control the timing of more than one set of cam lobes, and shows how such a device may be applied to a DOHC engine.

Vane type phasers use oil pressure signals from a hydraulic control valve to alter the valve timing in response to electrical signals from the ECU. A typical vane type phaser requires two oil feeds or supply lines, the first to advance the camshaft timing and the second to retard the camshaft timing. In order to control the intake and exhaust valve timing independently, a double vane phaser requires four oil feeds—a pair to control the intake timing and a pair to control the exhaust timing.

It has been proposed to engage these oil feeds into an open bore in the front of the phaser via an oil feed spigot mounted on the front cover of the engine. However, integrating the oil supply system into the front cover of the engine increases the overall length of the cylinder head and requires pressurised oil to be supplied to the front cover, which would not be the case in the majority of DOHC engines. Whilst there are many examples in the prior art of vane type phasers using control oil feeds that enter the phaser via the adjacent camshaft bearing, this would not be practical for a double vane phaser because of the space required for four separate oil feeds.

In most cases, the camshaft bearing adjacent the phaser is the most heavily loaded because it has to support the loads from the camshaft drive system as well as the loads from the valve train. This makes the adjacent bearing a particularly unattractive location for oil feeds, which significantly reduce the load carrying area of the bearing.

SUMMARY OF THE INVENTION

With a view to mitigating the foregoing disadvantages, there is provided in accordance with the present invention 1 engine cylinder head for an engine having a crankshaft rotatably mounted in an engine block, the cylinder head having a first camshaft, a second camshaft, a phasing system mounted to the first camshaft and transmitting torque from the engine crankshaft to both the first and the second camshaft, and first and second control valves for applying oil under pressure to the phasing system by way of oil feeds, to enable the timing of the first and the second camshafts respectively to be varied independently with respect to the engine crankshaft, wherein, in each oil feed connecting one of the control valves to the phasing system, oil passes into the first camshaft via an oil feed journal and flows to the phaser by way of an axially extending channel within the first camshaft.

Preferably, two oil feed journals are provided on the camshaft, each associated with a respective control valve, the two oil feed journals being separated from one another by one or more cam lobes.

Advantageously, an oil feed journal may overlie a cylinder head bolt.

An oil feed journal may additionally also serve as a bearing support for the camshaft.

The oil feed journal may be a close clearance fit on the camshaft such that the pressure in the oil feeds is maintained by the viscosity of the oil.

Alternatively, the oil feed journal may be a clearance fit on the camshaft and the pressure in the oil feeds may be maintained by separate sealing elements.

The axial channels in the camshaft may conveniently be defined by a separate insert fitted to the camshaft.

One or more oil feed journals and one or more camshaft bearing caps may form part of a single oil feed component.

The oil feed component may also provide a mounting point for a control valve.

Additionally, the oil feed journal may encase the camshaft such that the camshaft and the oil feed component may be assembled to the cylinder head as a sub-assembly.

BRIEF DESCRIPTION OF THE DRAWINGS

The invention will now be described further, by way of example, with reference to the accompanying drawings, in which.

DETAILED DESCRIPTION OF THE PREFERRED EMBODIMENT

Figure 1:
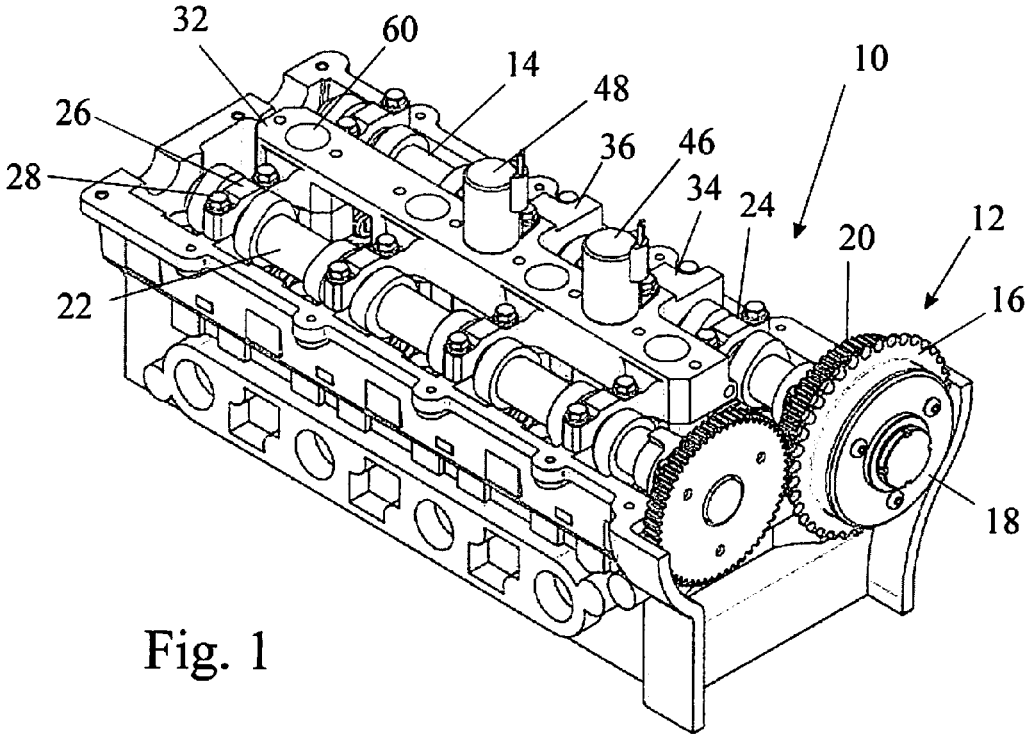
FIG. 1 is an isometric view of a DOHC cylinder head of the invention with double vane phaser.

The double overhead camshaft cylinder head 10 shown in FIG. 1 utilises a double vane phaser 12, as described in EP 1 234 954, mounted on the end of a first camshaft 14. The phaser 12 is driven by a drive sprocket 16 which is turn coupled for rotation with the engine crankshaft (not shown) by means of a toothed belt or a chain. The double vane phaser has front and rear phaser outputs 18 and 20. The front phaser output 18 is bolted to the first camshaft 14 while the rear phaser output 20 is a secondary drive gear which drives the second camshaft 22.

Two pairs of oil feeds into the double vane phaser 12 are required to allow independent control of the phasing of each camshaft 14, 22 relative to the crankshaft and the present invention is concerned with the manner in which these oil feeds are supplied to the double vane phaser 12.

As is conventional in DOHC cylinder heads, the camshafts 14, 22 are supported in multiple bearing journals or pillar blocks. Each pillar block has a lower half formed integrally with the cylinder head and a bearing cap bolted to the lower half. The bearing surfaces on the camshafts held within the pillar blocks are lubricated by an oil film supplied through the corresponding bearing surfaces in the pillar blocks. Typically, each pillar block is arranged between a pair of cam lobes associated with each cylinder.

Figure 2:
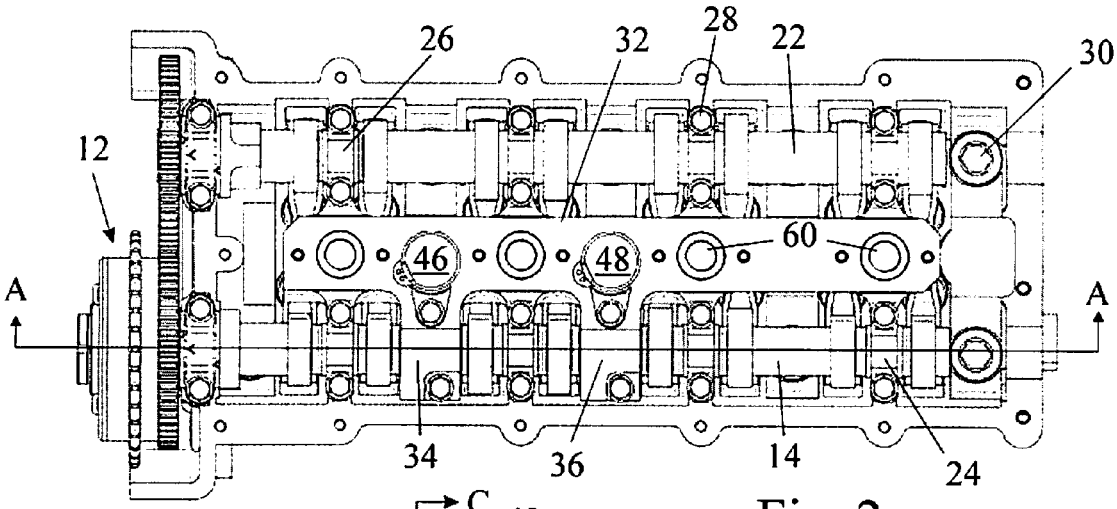
FIG. 2 is a top view of the cylinder head shown in FIG. 1.
Figure 3:
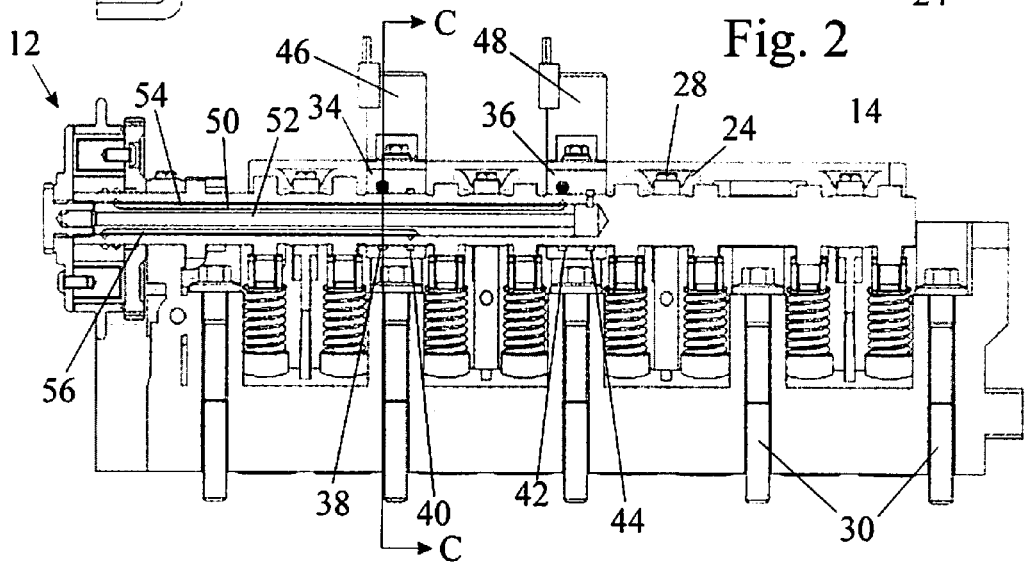
FIG. 3 is a sectional view along the camshaft centerline A-A as shown in FIG. 2.

FIGS. 2 and 3 show in more detail how the camshafts are supported in the cylinder head. Two pillar blocks 24, 26 are arranged on opposite sides of each cylinder in the same plane as the cylinder centerline. In the illustrated embodiment of the engine, the cylinder head 10 utilises a ladder frame 32 which combines all the bearing caps 24, 26 associated with both camshafts into a single component. The caps 24, 26 are bolted down using camshaft bolts 28.

Ten cylinder head bolts 30 (see FIG. 3) secure the cylinder head to the engine block but only two of these are visible in the plan view of FIG. 2, the remaining eight being obscured by the camshafts 14 and 22.

In addition to the pillar blocks 24 that support the camshaft 14, two oil feed journals 34, 36 are provided. Each oil feed journal has a surface that mates with the outer surface of the camshaft and contains two circumferential oil supply grooves 38, 40 and 42, 44 respectively. These four grooves supply pressurised oil through the camshaft 14 to the double vane phaser 12.

The oil feed journals have been shown in the drawings as a close fitting to the outer diameter of the camshaft. Alternatively, it would be possible to have a larger clearance between the journal and the camshaft and to use ring-type seals to retain the oil pressure in each pair of oil feeds.

Figure 5:
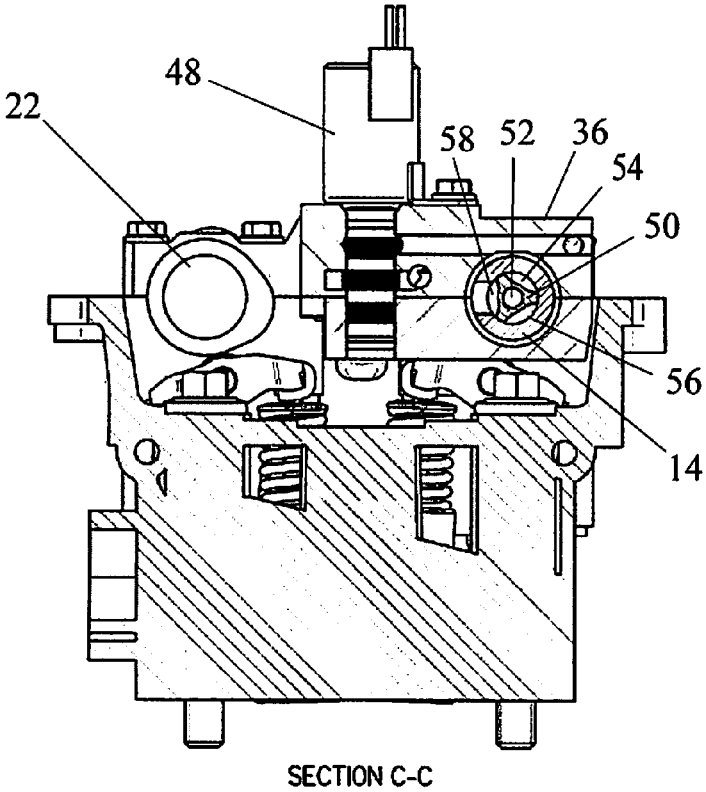
FIG. 5 is a sectional view of the cylinder head of FIG. 1, taken along the line C-C in FIG. 3.

While it would be possible to integrate the phaser oil feeds into the existing camshaft bearings in some applications, it is advantageous to separate the oil supply entirely from the load carrying bearings. This is the approach that has been adopted in the illustrated ladder frame. Hence, as can be seen in FIG. 5, the oil feed journals 34 and 36 are not bolted down to the cylinder head but are located above the heads of cylinder head bolts 30.

In order to control the phase of the camshafts 14, 22 the relative pressure of oil supplied via the different grooves 38, 40, 42 and 44 must be controlled. This is achieved using two control valves 46 and 48 that are also supported by the ladder frame 32, each respective valve controlling one of the two phasers outputs.

The two control valves 46, 48 can be located between adjacent cylinders of the engine. The position corresponding to the center of each cylinder is typically used for the spark plug in a gasoline engine, or the fuel injector in a diesel engine. These positions coincide with four bores 60 formed in the ladder frame 32, which allow access to the spark plugs or fuel injectors, as the case may be.

It will be appreciated that the axial space available on the camshaft 14 for oil feeds is much greater between cylinders of the engine than it is on the cylinder center line where the camshaft bearings are located. The oil feed journals may be fitted with individual bearing caps such that the camshaft 14 and the ladder frame 32 can be fitted as a unit, which avoids any problems associated with the oil feeds being directly above the cylinder head bolts 30.

Figure 4:
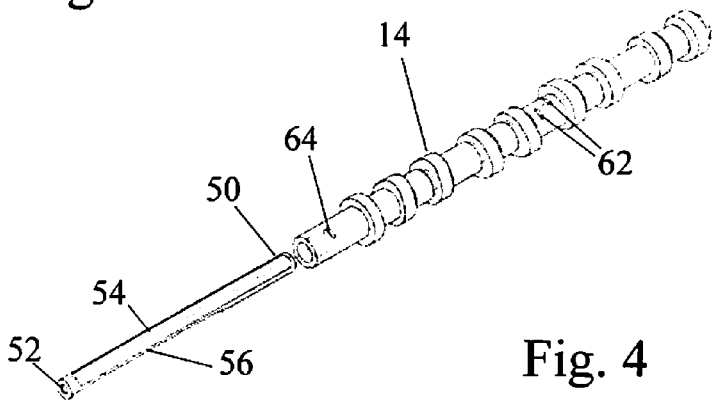
FIG. 4 is an exploded view of the camshaft and oil feed insert.

FIGS. 4 and 5 show the manner in which oil is conveyed through the camshaft 14 to the double vane phaser 12. In order to provide four independently controlled oil feeds there need to be four separate channels within the camshaft 14.

As shown in the exploded view of FIG. 4, this is achieved by using a hollow camshaft 14 provided with four axially and circumferentially spaced radial drillings 62, only some of which are visible in FIG. 4. An insert 50 is placed into the hollow camshaft 14 which itself includes a hollow axial bore 52. Three elongated grooves in the outer surface of the insert 50 define in conjunction with the inner wall of the hollow camshaft 14 three circumferentially spaced channels 54, 56, 58. These, along with the axial channel formed by the bore 52, each communicate with a respective one of the four radial drillings 62. The cross section of the combined camshaft 14 and insert 50 can be most clearly seen in FIG. 5.

The channels terminate at the end of the camshaft 14 upon which the double vane phaser 12 is mounted. Each channel 52, 54, 56, 58 terminates in an oil supply slot 64 similar to the slots 62. The four oil supply slots 64 are axially and circumferentially spaced from one another, each pair of slots communicating with the respective opposed working chambers within each of the two phasers.

As will be apparent from the foregoing description, the preferred embodiments of the invention offer the following advantages over the prior art, namely:

Reduced cylinder head length because the control oil feeds can be accommodated within the length of the conventional cylinder head.

Removes the need for pressurised oil in the engine front cover.

Utilises the existing oil supply within the cylinder head to feed the phaser control valves.

Allows compact integration of the phaser control valves into the engine design.

It will be appreciated that the invention is not limited to what has been described hereinabove merely by way of example. While there have been described what are at present considered to be the preferred embodiments of this invention, it will be obvious to those skilled in the art that various other embodiments, changes, and modifications may be made therein without departing from the spirit or scope of this invention and that it is, therefore, aimed to cover all such changes and modifications as fall within the true spirit and scope of the invention, for which letters patent is applied.

What is claimed is:

1. A camshaft phasing system for an internal combustion engine, having an engine block, a crankshaft rotatably mounted in the engine block, a cylinder head and engine valves, the phasing system comprising:

first and second camshafts for operating the engine valves, the first camshaft having a plurality of axially extending channels therein;

a phaser mounted on the first camshaft having an input rotatably coupled to the crankshaft, a first output coupled to the first camshaft, a second output driving the second camshaft, and oil feeds in fluid communication with at least some of the plurality of channels;

first and second control valves for applying oil under pressure to the phaser via at least some of the plurality of channels in the first camshaft, to enable the timing of the first and the second camshafts, respectively, to be varied independently with respect to the engine crankshaft;

wherein the first camshaft is hollow and the axial channels in the camshaft are defined by a separate insert fitted inside a hollow first camshaft.

2. A camshaft phasing system as claimed in claim 1, further comprising an oil feed journal and wherein the oil feed journal is fluid communication with at least one of the channels, for communicating the oil pressure applied by at least one of the control valves to the phaser.

3. A camshaft phasing system as claimed in claim 2 having at least two oil feed journals each associated with a respective control valve, the oil feed journals being separated by one or more cam lobes.

4. A camshaft phasing system as claimed in claim 2, wherein the oil feed journal overlies a hole for a bolt serving to secure the cylinder head to an engine block.

5. A camshaft phasing system as claimed in claim 2, wherein the oil feed journal additionally serves as a bearing support for the camshaft.

6. A camshaft phasing system as claimed in claim 2, wherein the oil feed journal is a close clearance fit on the first camshaft and wherein the pressure in the oil feeds is being maintained by the viscosity of the oil.

7. A camshaft phasing system as claimed in claim 2, wherein the oil feed journal is a clearance fit on the first camshaft, and wherein the pressure in the oil feeds is being maintained by separate sealing elements.

8. A camshaft phasing system as claimed in claim 2, wherein the camshafts are supported on the cylinder head in pillar blocks having separable bearing caps, and wherein one or more oil feed journals and one or more camshaft bearing caps are formed as part of a single oil feed component.

9. A camshaft phasing system head as claimed in claim 2, wherein the oil feed journal also provides a mounting point for a control valve.

10. A camshaft phasing system as claimed in claim 9, wherein an oil feed journal encases the first camshaft such that the camshaft and the oil feed component may be assembled to the cylinder head as a sub-assembly.

* * * * *